United States Patent [19]

Dazza

[11] Patent Number: 4,542,831

[45] Date of Patent: Sep. 24, 1985

[54] CLEATING APPARATUS

[75] Inventor: Renald A. Dazza, Huntington Beach, Calif.

[73] Assignee: Bayshore Tile Company, Costa Mesa, Calif.

[21] Appl. No.: 548,246

[22] Filed: Nov. 3, 1983

[51] Int. Cl.[4] ..... A47G 29/02

[52] U.S. Cl. ..... 211/90; 52/36; 4/643; 108/42; 248/251; 312/245

[58] Field of Search ..... 52/36; 248/251; 211/90; 312/111, 210, 210.5, 228, 5, 6, 242, 245; 108/42, 152; 4/630, 631, 643, 647, 648

[56] References Cited

U.S. PATENT DOCUMENTS

| | | | |
|---|---|---|---|
| 178,534 | 6/1876 | Latham . | |
| 1,127,596 | 2/1915 | Crabiel . | |
| 1,504,336 | 8/1924 | Foster . | |
| 1,850,292 | 3/1932 | Skelly | 52/36 X |
| 1,858,648 | 5/1932 | Wahnsiedler . | |
| 2,716,533 | 8/1955 | Freeman . | |
| 2,732,159 | 1/1956 | Connors et al. . | |
| 2,849,123 | 8/1958 | Magill | 108/42 |
| 3,298,655 | 1/1967 | Palm . | |
| 3,376,681 | 4/1968 | Bach, Jr. | 4/631 X |
| 3,381,636 | 5/1968 | Saiberlich | 108/42 X |
| 3,388,884 | 6/1968 | Eggler et al. . | |
| 3,429,539 | 2/1969 | Lucietto et al. . | |
| 3,795,380 | 3/1974 | Turner . | |
| 4,008,872 | 2/1977 | Thompson . | |
| 4,018,019 | 4/1977 | Raith et al. | 52/36 X |
| 4,180,298 | 12/1979 | Borgerson, Jr. | 312/242 |
| 4,407,476 | 10/1983 | Bohannan | 211/90 X |
| 4,408,812 | 10/1983 | Krautwurst | 312/245 X |

*Primary Examiner*—J. Karl Bell
*Assistant Examiner*—Richard E. Chilcot, Jr.
*Attorney, Agent, or Firm*—Fulwider, Patton, Rieber, Lee & Utecht

[57] ABSTRACT

A cleating apparatus for mounting a vanity top from a pair of oppositely disposed vertical return walls formed in the recess of a room. The apparatus includes a pair of oppositely disposed rails for mounting in a horizontal orientation on such return walls, in horizontal alignment with one another. The respective rails are formed at their front ends with respect to upwardly opening notches having downwardly and rearwardly inclined wedge surfaces. A skirt is provided for covering the front ends of such rails and have respective brackets on the opposite ends thereof and projecting rearwardly therefrom in coextensive relationship with such rails. Mounted to the opposed sides of such brackets are triangular wedged blocks having respective downwardly and rearwardly inclined surfaces for complimental engagement with the notch wedge surfaces. The blocks are mounted from the brackets a distance rearwardly of the backside of the skirt to cooperate therewith when nested in the respective notches to cause the skirt to be drawn rearwardly into engagement with such front ends under the influence of gravity when the blocks are nested in the respective notches.

9 Claims, 5 Drawing Figures

FIG. 1
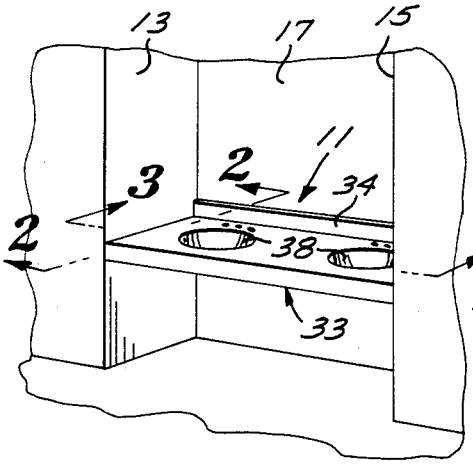
FIG. 2
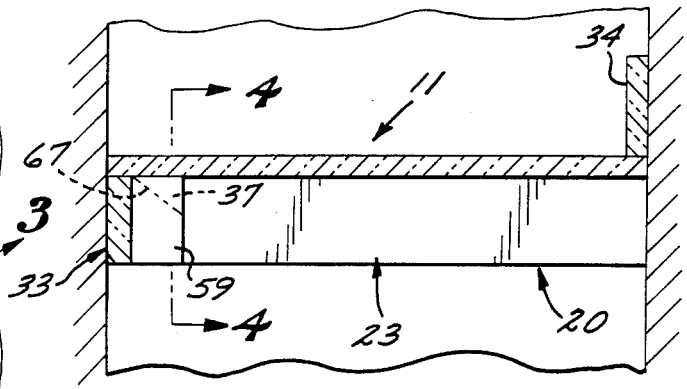
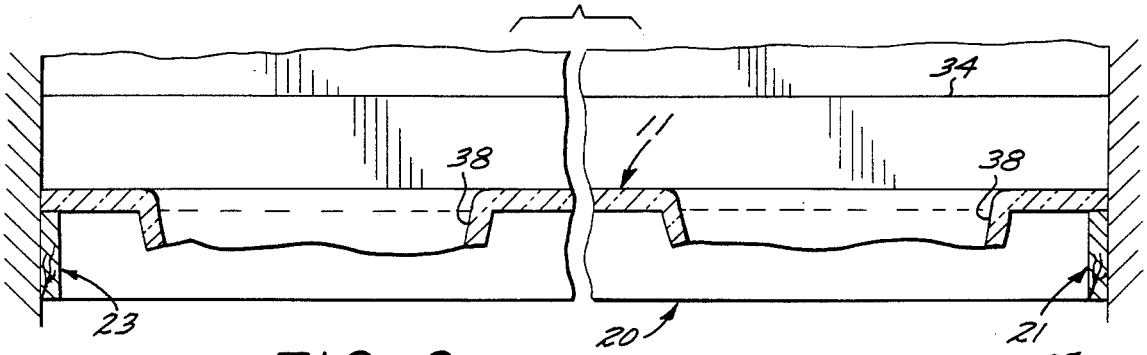
FIG. 3
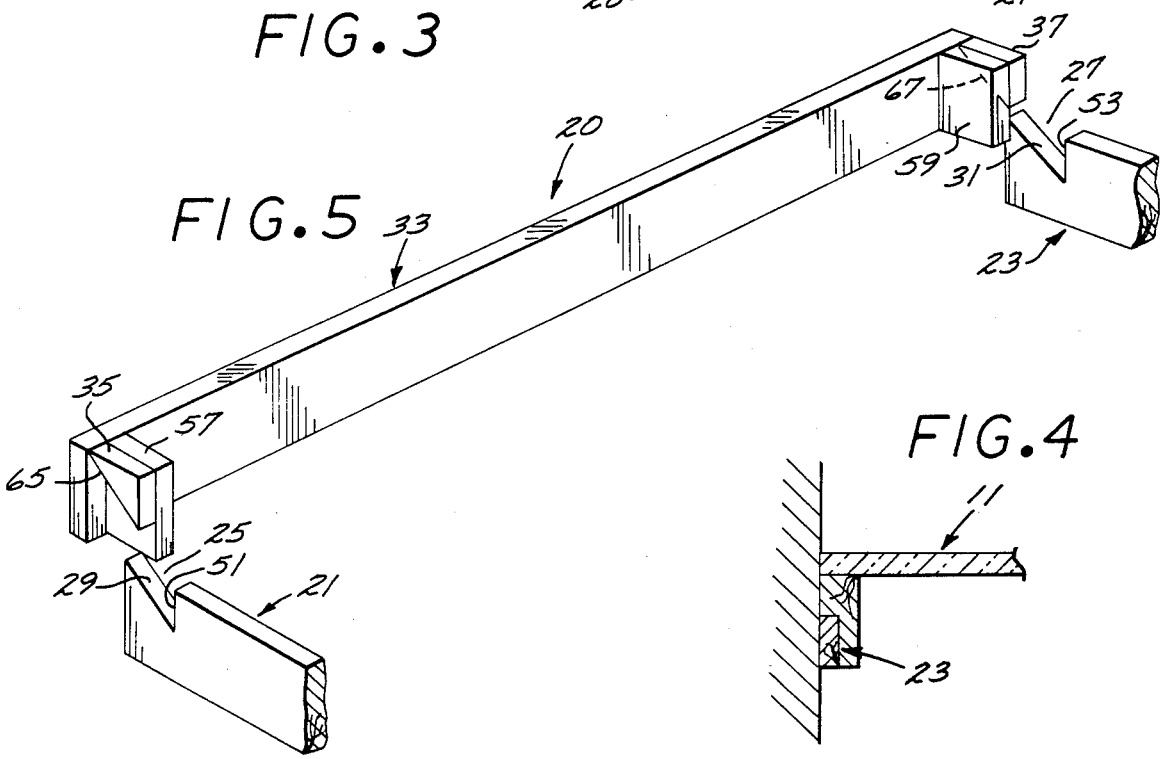
FIG. 5
FIG. 4

CLEATING APPARATUS

BACKGROUND OF THE INVENTION

1. Field of the Invention

The present invention relates to a cleating apparatus for mounting a vanity top within a recess formed in one side wall of a room such as a hotel or motel room.

2. Description of the Prior Art

In modern day hotel and motel rooms, it is common practice to provide a vanity table in the bathroom area or elsewhere which includes a vanity top, typically having a sink basin recessed therein. It is common practice to form such vanity top such that it closely fits the entire horizontal surface of the recess as viewed in top plan view. The difficulties attendant installation of such vanity tops are well known in the trade. Since such vanity tops are typically of an imitation marble material, such as Corian as manufactured by Dupont, the maneuvering of such tops into position for installation and the fitting of and the securement thereof to the room walls for support has proven to be an inconvenient and tedious task.

Typically, such vanity tops are supported from the recess in the wall of the hotel or motel room by attaching wooden rails in horizontal alignment to the opposed return walls and then attaching a rail along the rear wall. After such rails are so attached, a Corian plate forming the top surface of a vanity table is tediously moved into position and brought to rest on the top edges of such rails. A skirt is then typically mounted at the front of the rails, underneath the plate forming the vanity top to thus conceal the support rails and lend a balanced appearance adding to the aesthetics of the installation. In the process of completing the interior construction of the room being fitted with such a vanity, it has been found necessary to install the vanity top of the conventional contruction immediately after the dry wall is put into place thus limiting the flexibility of scheduling during construction.

Numerous different efforts have been made to provide cleating supports for various installations, other than vanity top installations. No such devices have been found readily adaptable to the vanity top installation in such a manner as to provide a fully satisfactory support arrangement which may be rapidly installed and which will readily receive the vanity top at any time during the time the interior of the room is being completed.

Representative of various efforts to provide cleating which will readily receive and mount various fixtures include sinks formed at their rear extremities with risers having at the backside thereof, down turned hooks for receipt in upwardly opening sockets. A device of this type is shown in U.S. Pat. No. 1,858,648. While satisfactorily serving the purpose for which the arrangement was intended, such hook and socket arrangements are unsatisfactory for mounting vanity skirts and the tops thereof.

Other efforts to develop bracketing for quick mounting of various devices have led to the provision of outwardly opening rails formed with down turned pockets for receipt of hooks carried from a element to be suspended from the rail. A device of this type is shown in U.S. Pat. No. 4,088,872. While serving the purpose intended, such devices are not readily adaptable to rapid and convenient mounting of a vanity skirt.

SUMMARY OF THE INVENTION

The cleating apparatus of the present invention is characterized by a pair of opposed side rails formed at their front extremities with upwardly opening notches having downwardly and rearwardly inclined wedge surfaces. A skirt is mounted at the front ends of such rails by means of brackets which extend rearwardly adjacent the rails and have mounted on the opposed sides thereof, wedge blocks which engage the downwardly and rearwardly inclined surfaces to ride downwardly and rearwardly thereon as such blocks are nested in the notches to draw the skirt rearwardly against the front ends of such rails.

The objects and advantages of the present invention will become apparent from the consideration of the following detailed description when taken in conjunction with the accompanying drawings.

BRIEF DESCRIPTION OF THE DRAWINGS

FIG. 1 is a perspective view of a vanity top supported on a cleating apparatus of the present invention;

FIG. 2 is a transverse vertical sectional view, in enlarged scale taken along the line 2—2 of FIG. 1;

FIG. 3 is a longitudinal sectional view, in enlarged scale, taken along the line 3—3 of FIG. 1;

FIG. 4 is a vertical sectional view taken along the line 4—4 of FIG. 2; and, FIG. 5 is an exploded perspective view, in enlarged scale of the cleating apparatus of the present invention.

DESCRIPTION OF THE PREFERRED EMBODIMENT

The vanity cleating apparatus of the present invention is particularly adapted for supporting a vanity top 11 from the opposed side walls 13 and 15 of a recess 17 in a room. The cleating apparatus, generally designated 20 includes a pair of side rails 21 and 23 formed at their respective front extremities with upwardly opening notches 25 and 27 which have their front walls in the form of downwardly and rearwardly sloped surfaces 29 and 31. Mounted to the rear sides of the opposite ends of a vanity skirt 33, are a pair of wedge blocks 35 and 37 which are configured and disposed relative to the back surface of the skirt 33, when nested in the respective notches 25 and 27 to act under the influence of gravity, draw the skirt 33 rearwardly against the front ends of the rails 21 and 23.

The recess 17 may typically be formed on one sidewall of a motel or hotel room wherein a vanity top 11 is to be mounted to serve as a mounting element for sink basins 38 and provide a water repellant hard surface for resisting stain and damage from frequent use, while having aesthetic appeal. The vanity top 11 is typically constructed of Corian, available from Dupont, and has its underside shrouded at the front edge by means of a Corian skirt 33. A Corian molding 34 frequently rises upwardly from the backside of the top 11.

In the preferred embodiment, the rails 21 and 23 are constructed of wood and terminate at their respective one ends with vertical front edges 45 and 47 which are abutted by the backside of the skirt 33 to maintain such skirt in its vertical orientation. The front walls 29 and 31 of the notches 25 and 27 angle downwardly and rearwardly at a angle of approximately 45° to the vertical and join respective vertical surfaces 51 and 53 forming the back walls of such notches.

The skirt 33 has mounted at the opposite ends thereof a pair of rearwardly projecting brackets 57 and 59 which project parallel in juxtaposition with the respective rails 21 and 23. The brackets 57 and 59 may also be formed of Corian and are bonded at their front extremities to the backside of the skirt 33 by means of a bonding agent 61. Mounted to the opposed sides of the respective brackets 57 and 59 are the respective wedge blocks 35 and 37 which are also constructed of Corian. The wedge blocks 35 and 37 are preferably of a configuration complimental to that of the respective notches 25 and 27 with the downwardly facing front surfaces thereof angling at an angle of 45° to the vertical to form respective slider surfaces 65 and 67 for engaging the respective wedge surfaces 29 and 31 to slide smoothly downwardly and rearwardly thereon thereby forming a smooth and secure contact therewith. In operation, the rails 21 and 23 for an entire complex of rooms may be pre-cut to the standard length to extend the full length of the walls 13 and 15 and the notches 25 and 27 preformed therein. Likewise, the skirt 33 may be preformed and the brackets 61 and the wedge blocks 35 and 37 pre-cut to a uniform size and configuration and bonded to the exterior surfaces of the respective brackets 57 and 59, all in a predetermined orientation for causing the drawing of the skirt 33 toward the respective ends 45 and 47 of the rails 21 and 23 upon assembly to be described hereinafter. The brackets 57 and 59 with the wedge blocks 35 and 37 mounted thereon may then be bonded to the rear sides of the respective skirts 33 by the bonding agent 61. It will be appreciated that the vanity top 11 and molding 41 are all pre-cut and stacked at the job site for rapid and convenient installation.

When the on site installation commences, the workmen need merely determine the height at which the respective rails 21 and 23 are to be positioned. This step may, if desirable, be facilitated by means of a jig or other positioning apparatus. Depending on the material in the studding of the walls 13 and 15, the wooden rails 21 and 23 may be nailed or screwed to the walls and/or studding supporting such walls. If desirable, a back rail may be mounted against the back wall. With the rails 21 and 23 so mounted from the walls 13 and 15 in opposed relationship, the preformed end assembled skirts 33 may be moved into position with the respective wedge block 35 and 37 disposed above, and in alignment with, the notches 25 and 27. The skirt unit may then be lowered into such position causing the sliding surfaces 65 and 67 to engage the wedge surfaces 29 and 31 of the respective notches 25 and 27 to thus cause the weight of the skirt to urge the respective blocks downwardly and rearwardly in the notches 25 and 27 thereby drawing such skirt rearwardly and causing the back wall thereof to engage the respective vertical front end 45 and 47 of the respective rail 21 and 23. As such blocks 35 and 37 reach their nested position, the backside of the skirt will be firmly engaged against the front edges 45 and 47 thus causing the skirt to be held securely in position. The skirt thus conceals the cleats 21 and 23 from the room occupants. The vanity top slab 11 may then be merely laid in position on the cleats 21 and 23 and, if desirable, rapidly cemented thereto. The molding 41 may then be installed to fully complete the installation.

From the foregoing, it is apparent that the cleating apparatus of the present invention provides an economical and foolproof means for installing vanity tops in a rapid and efficient manner while achieving the desired aesthetics.

I claim:

1. A cleating apparatus for mounting on coextensive opposed vertical return walls formed by a recess from a room for supporting therefrom a horizontal top and vertical front skirt, said apparatus comprising:

a pair of side rails for mounting on said return wall and including at the respective one extremities thereof adjacent said room with upwardly opening notches formed proximate said one extremities with downwardly and rearwardly inclined wedge surfaces;

a pair of brackets mounted on the opposite ends of said skirt and projecting rearwardly therefrom; and, a pair of wedge blocks mounted on said respective brackets and formed with downwardly and rearwardly inclined slide surfaces shaped to complimentally fit said wedge surfaces and spaced from the back side of said skirt to cause gravity to draw said skirt against said one ends of said respective rails when the weight thereof is carried in said notches by said blocks whereby said rails may be mounted on said return walls, said blocks fitted in said respective notches to suspend said skirt therefrom for receipt thereover of said top.

2. The cleating apparatus of claim 1 wherein:

said side rails are of a length to project across the full length of said respective return walls.

3. The cleating apparatus of claim 1 that includes:

bonding means for bonding said brackets to said skirt.

4. The cleating apparatus of claim 1 wherein:

said notches are found on their respective front side with vertical walls.

5. The cleating apparatus of claim 1 wherein:

said rails are formed on their respective one extremities with vertically extending ends; and said respective wedge blocks are spaced from the rear side of said skirt a distance sufficient to cause said backside of said skirt, when said blocks are nested in said respective notches, to engage said respective vertical ends.

6. The cleating apparatus of claim 1 wherein:

said rails are constructed of wood.

7. The cleating apparatus of claim 5 wherein:

said side rails are of a length to project across the full length of said respective return walls.

8. The cleating apparatus of claim 5 wherein:

bonding means for bonding said brackets to said skirt.

9. The cleating apparatus of claim 5 wherein:

said notches are formed on the respective front side with vertical walls.

* * * * *